US006945491B2

(12) United States Patent
Gambini

(10) Patent No.: US 6,945,491 B2
(45) Date of Patent: Sep. 20, 2005

(54) DEVICE FOR RE-REELING AND FORMING A ROLL OF PAPER IN A RE-REELING MACHINE

(76) Inventor: Giovanni Gambini, Via A. Omodeo 7 - I, 56124 Pisa (IT)

( * ) Notice: Subject to any disclaimer, the term of this patent is extended or adjusted under 35 U.S.C. 154(b) by 0 days.

(21) Appl. No.: 10/105,707

(22) Filed: Mar. 25, 2002

(65) Prior Publication Data

US 2002/0179768 A1 Dec. 5, 2002

(30) Foreign Application Priority Data

Jun. 1, 2001 (IT) ..... MI20010306 U

(51) Int. Cl.[7] ..... B65H 35/10
(52) U.S. Cl. ..... 242/521; 242/532.3; 242/542.2
(58) Field of Search ..... 242/521, 532.3, 242/542.2

(56) References Cited

U.S. PATENT DOCUMENTS

| | | | | |
|---|---|---|---|---|
| 4,327,877 A | * | 5/1982 | Perini | 242/521 |
| 5,137,225 A | * | 8/1992 | Biagiotti | 242/521 |
| 5,542,622 A | * | 8/1996 | Biagiotti | 242/521 |
| 5,603,467 A | * | 2/1997 | Perini et al. | 242/521 |
| 5,690,296 A | * | 11/1997 | Biagiotti | 242/521 |
| 5,769,352 A | * | 6/1998 | Biagiotti | 242/521 |
| 5,772,149 A | | 6/1998 | Butterworth | |
| 5,979,818 A | * | 11/1999 | Perini et al. | 242/521 |
| 6,056,229 A | * | 5/2000 | Blume et al. | 242/521 |
| 6,098,916 A | * | 8/2000 | Matteucci et al. | 242/527.3 |
| 6,494,398 B1 | * | 12/2002 | De Matteis et al. | 242/521 |

FOREIGN PATENT DOCUMENTS

| | | |
|---|---|---|
| EP | 0 408 526 | 1/1991 |
| EP | 1 006 066 | 6/2000 |

OTHER PUBLICATIONS

EP Search Report.

* cited by examiner

*Primary Examiner*—Kathy Matecki
*Assistant Examiner*—Sang Kim
(74) *Attorney, Agent, or Firm*—Hedman & Costigan, P.C.

(57) ABSTRACT

A device for re-reeling and forming a roll of paper in a re-reeling machine comprising, on a frame, three rollers (16, 17, 18) having mutually parallel axes that are perpendicular to the direction of feed of the paper (11), in which two winding rollers, a bottom one (17) and a top one (16), supported on the frame, co-operate with a third roller (18) that maintains a certain pressure on a roll of paper or log being formed, where the third roller (18) is carried by a pair of arms (22) which can oscillate with respect to the frame, the paper (11) that is being wound passing over one of the two rollers, and the finished roll or log (19) coming out of an outlet aperture or gap (30) identified between the bottom roller and the third roller, and the cores (12) for said rolls being fed, one after another, by a pusher conveyor (15) and being introduced into a channel (24) made underneath the top roller (16) by an oscillating pusher (27, 35) which co-operates for inserting the core (12), possibly provided with adhesive, there also being provided an arrest element (32, 132) for at least partial arrest of the paper (11) upstream of the point of insertion of the core (12).

7 Claims, 5 Drawing Sheets

DEVICE FOR RE-REELING AND FORMING A ROLL OF PAPER IN A RE-REELING MACHINE

The present application claims priority to Italian Patent Application Serial No. MI 2001U 000306, filed Jun. 1, 2001.

BACKGROUND OF THE INVENTION

The present invention relates to a device for re-reeling and forming a roll of paper in a re-reeling machine.

It is known that in machines or assemblies for winding paper for domestic use, in particular paper subsequently to be used as toilet paper, wipes, serviettes, handkerchiefs and the like, there are provided elements that guide the incoming paper and control proper winding thereof onto a core to produce a finished roll referred to as "log".

Such machines, known as re-reeling machines, have two winding rollers and a third pressure roller. The two former rollers bring about winding of the paper into a roll, which progressively grows in diameter, whilst the third roller, in addition to co-operating in this winding operation, maintains a certain pressure on the roll or log to make sure that it is wound in a compacted way.

The two rollers have a position that is fixed with respect to the frame and support the log, drawing along the paper, whilst the third roller, acting as pressure roller, exerts pressure on the log being formed and hence determines the diameter of the finished product.

The third roller, or "pressure roller", is supported at opposite ends of at least one pair of arms that are pivoted to the frame. The third roller can thus oscillate according to a curved direction about the pivoting axis of the arms. Alternatively, this roller may also undergo control of the pressure that acts on it by means of a sensor.

Over time there have been developed various assemblies and devices for feeding the core of the roll, as well as for separating the finished roll and simultaneously positioning the leading end of the incoming paper on the new core.

For the above purpose, the Italian patent No. 1 262 046 illustrates the arrangement of a means for interrupting the ribbon-like material, which cooperates with means for feeding along a channel, between a position of insertion of a new core and a groove or outlet gap for the core between the three rollers so as to enable the roll of paper to be wound.

The arrangement of the aforesaid interruption means in an internal area of the channel involves a somewhat complicated process of synchronization between the parts and does not enable the re-reeling operation to be accelerated.

SUMMARY OF THE INVENTION

The main purpose of the present invention is thus to provide a device for re-reeling and forming a roll of paper in a re-reeling machine which will overcome all the problems and drawbacks referred to above and which will guarantee proper operation at high speeds.

Another purpose of the present invention is to provide a device that will be able to overcome the operating problems of synchronization between the aforesaid interruption means and the acceleration of the pressure roller, without causing any release or slackening of the paper.

Yet a further purpose of the invention is that of providing a device which, whilst solving the problems referred to above, is particularly simple and effective and does not cause squeezing of the outgoing finished roll or log.

These purposes according to the present invention are achieved by providing a device for re-reeling and forming a roll of paper in a re-reeling machine, comprising three rollers (16, 17, 18) having mutually parallel axes that are perpendicular to the direction of feed of paper (11), wherein said three rollers are supported on a frame, wherein two of said rollers are winding rollers, a bottom winding roller (17) and a top winding roller (16), which co-operate with a third roller (18) that maintains a certain pressure on said roll of paper or log, wherein said third roller (18) is supported by a pair of arms (22) which oscillate with respect to said frame, wherein said paper (11) passes over one of said two winding rollers and a finished roll or log (19) comes out of an outlet aperture or gap (30) located between said bottom winding roller and said third roller, wherein cores (12) for said rolls of paper which are fed one after another by a pusher conveyor (15) are introduced at a point of insertion into a channel (24) located underneath said top winding roller (16) by an oscillating pusher (27, 35) which co-operates to insert said cores (12) between said two winding rollers, wherein said oscillating pusher is optionally provided with adhesive, said re-reeling machine further comprising an arrest element (32, 132) for at least partial arrest of said paper (11) upstream of said point of insertion of said cores (12).

Further more detailed characteristics are presented in the subsequent claims.

BRIEF DESCRIPTION OF THE DRAWINGS

The structural and functional characteristics and advantages of a device for re-reeling and forming a roll of paper in a re-reeling machine will emerge more clearly from the ensuing description provided by way of non-limiting example, with reference to the attached schematic drawings, in which.

DETAILED DESCRIPTION OF THE INVENTION

Figure 1:
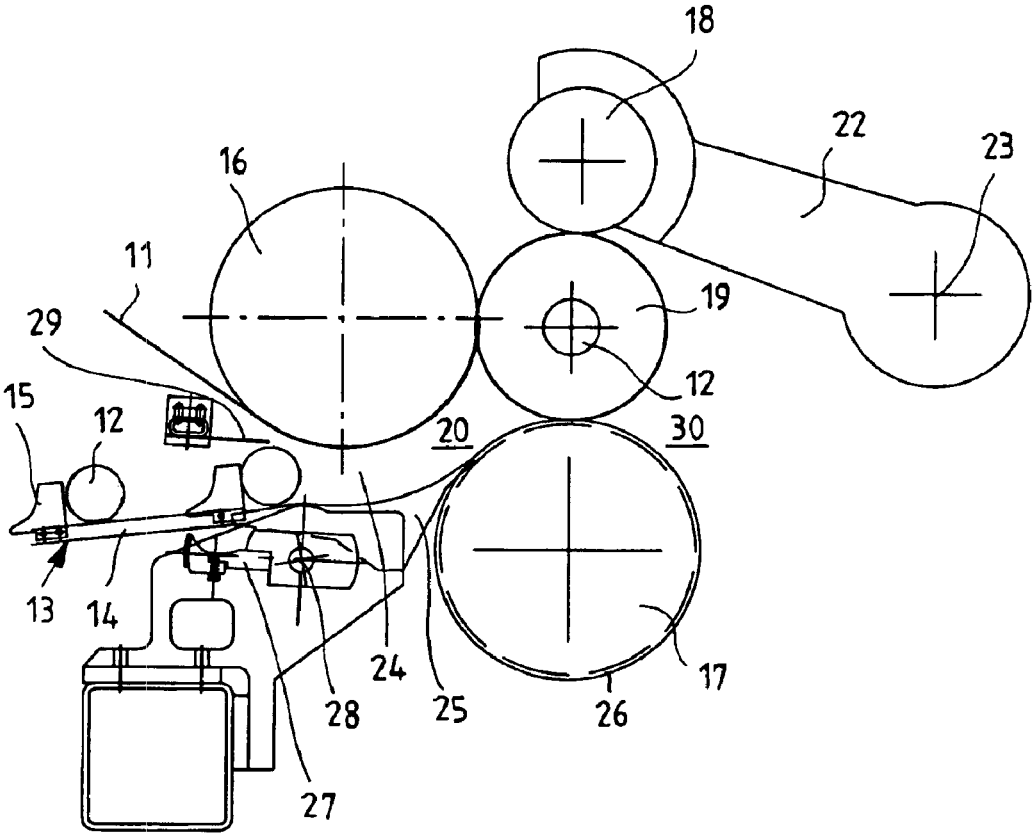
FIG. 1 is a schematic side elevation view of a device for re-reeling and forming a roll of paper in a re-reeling machine according to the present invention.
Figure 5:
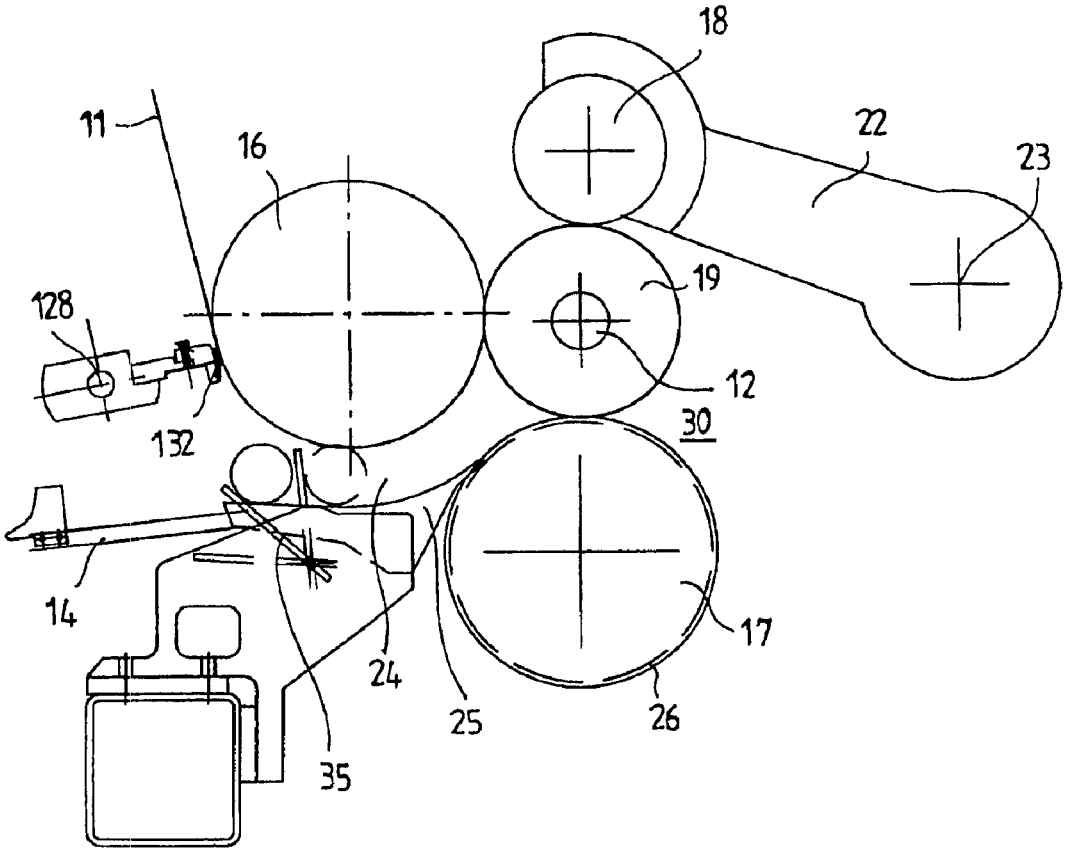
FIG. 5 shows a third example of embodiment of the present invention.

With reference to FIGS. 1 and 5, there is shown a central part of a machine for winding paper 11, in particular paper to be used as toilet paper, wipes, serviettes, handkerchiefs and the like, in which there is set the device for re-reeling and forming a roll of paper according to the present invention. The paper 11 that is fed in is made up of one or more combined ribbons or layers, once the latter have been unrolled from respective rolls (not shown).

The paper 11 in the form of a ribbon or web comes off a large roll (not shown) and must be wound onto a tubular core 12. The cores 12 are fed in one after another by means of a pusher conveyor 13 provided with pushers 15. The pusher conveyor 13 comprises, for example, chains 14, which are parallel to one another (only one of these is shown in the figure) and on which pushers 15 are arranged, which are set at a distance apart from one another and pick up the cores 12 from a magazine (not shown). The said pusher conveyor 13 carries the tubular cores 12 towards an arrangement of three rollers 16, 17 and 18, which guide the incoming continuous web of paper 11 and control it so that it winds properly onto each core 12 to form a finished roll of a given size, commonly referred to as "log", and designated by 19.

The three rollers 16, 17, and 18 have mutually parallel axes, which are perpendicular to the direction of feed of the paper 11. Two of the aforesaid three rollers, namely the rollers 16 and 17, which are supported by the frame, co-operate with the third roller 18.

The third roller 18 maintains a certain pressure on the roll or log being formed, to ensure proper winding of the paper. The said roller 18, known as "pressure roller", is supported at opposite ends of at least one pair of arms which are pivoted in 23 to the frame, one of these arms being schematically represented in 22 in the figure. The roller 18 undergoes a control of the pressure that acts thereon by means of a sensor or similar element (not shown).

The rollers 16 and 17 form between them an intake aperture or gap 20 in the set of three rollers 16, 17, 18.

In addition, according to the invention, the cores 12 fed by the pushers 15 of the conveyor 13 are inserted into a channel 24 that is defined by curved elements 25, set side by side (only one of these being shown in the figure), designed to be inserted at least partially, by means of their ends, within channels or grooves 26 made in the outer surface of the bottom roller 17. The bottom roller 17 may in any case also be smooth, and the said curved elements in this case rest on the surface thereof.

The channel 24 terminates at an intake aperture or gap 20, identified between the top roller 16 and the bottom roller 17, where the channel 24 is altogether similar in size to the outer diameter of the core 12.

At the intake of the said channel 24 there may be provided a dispenser element 29 for dispensing adhesive.

For reasons of completeness, it should be pointed out that an outlet aperture or gap 30 for exit of the finished roll is identified between the bottom roller 17 and the third roller, or pressure roller, 18.

Figure 2:
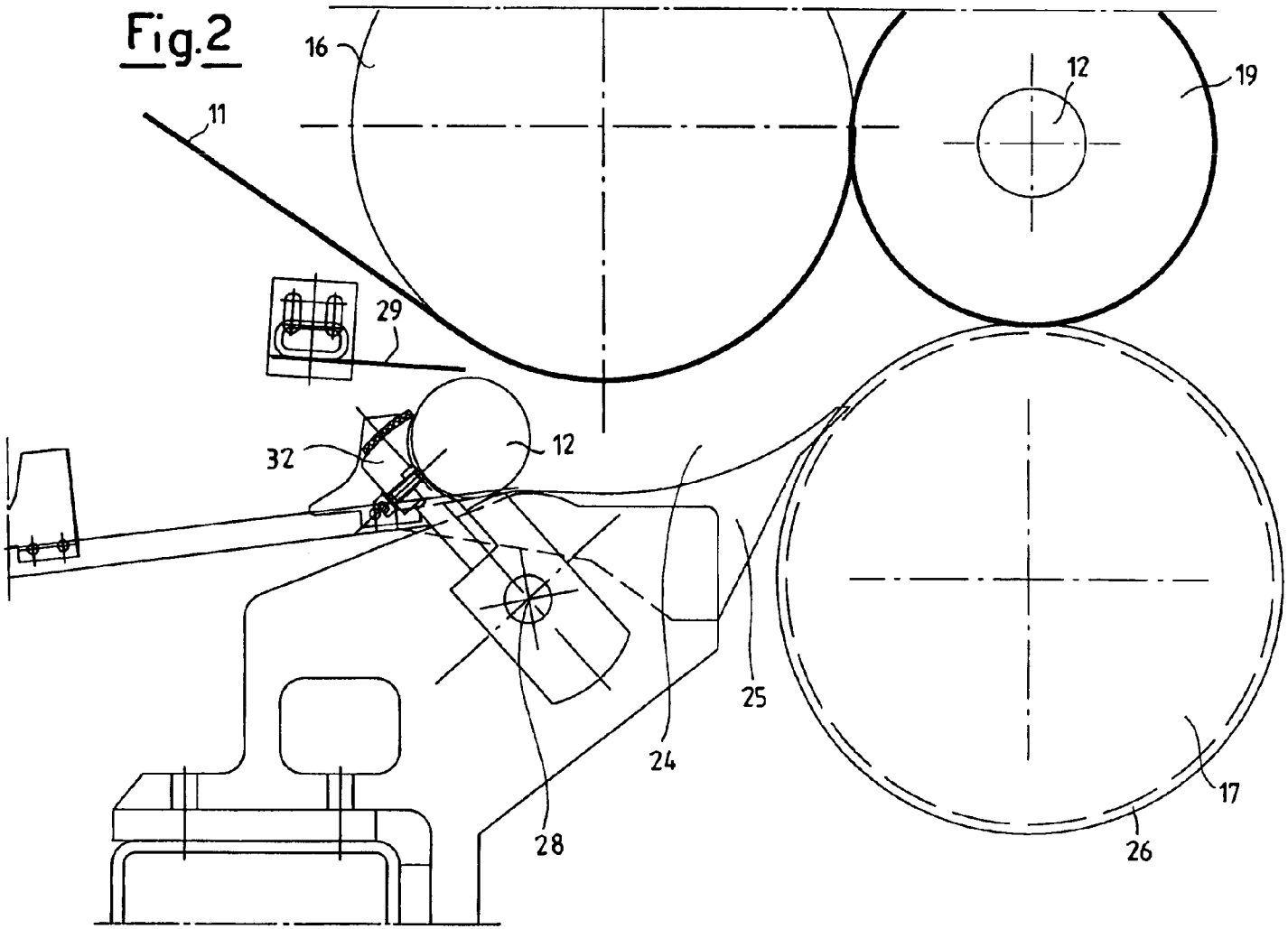
FIG. 2 illustrates an enlarged detail of what is illustrated in FIG. 1 in an immediately subsequent operating step of the device.
Figure 3:
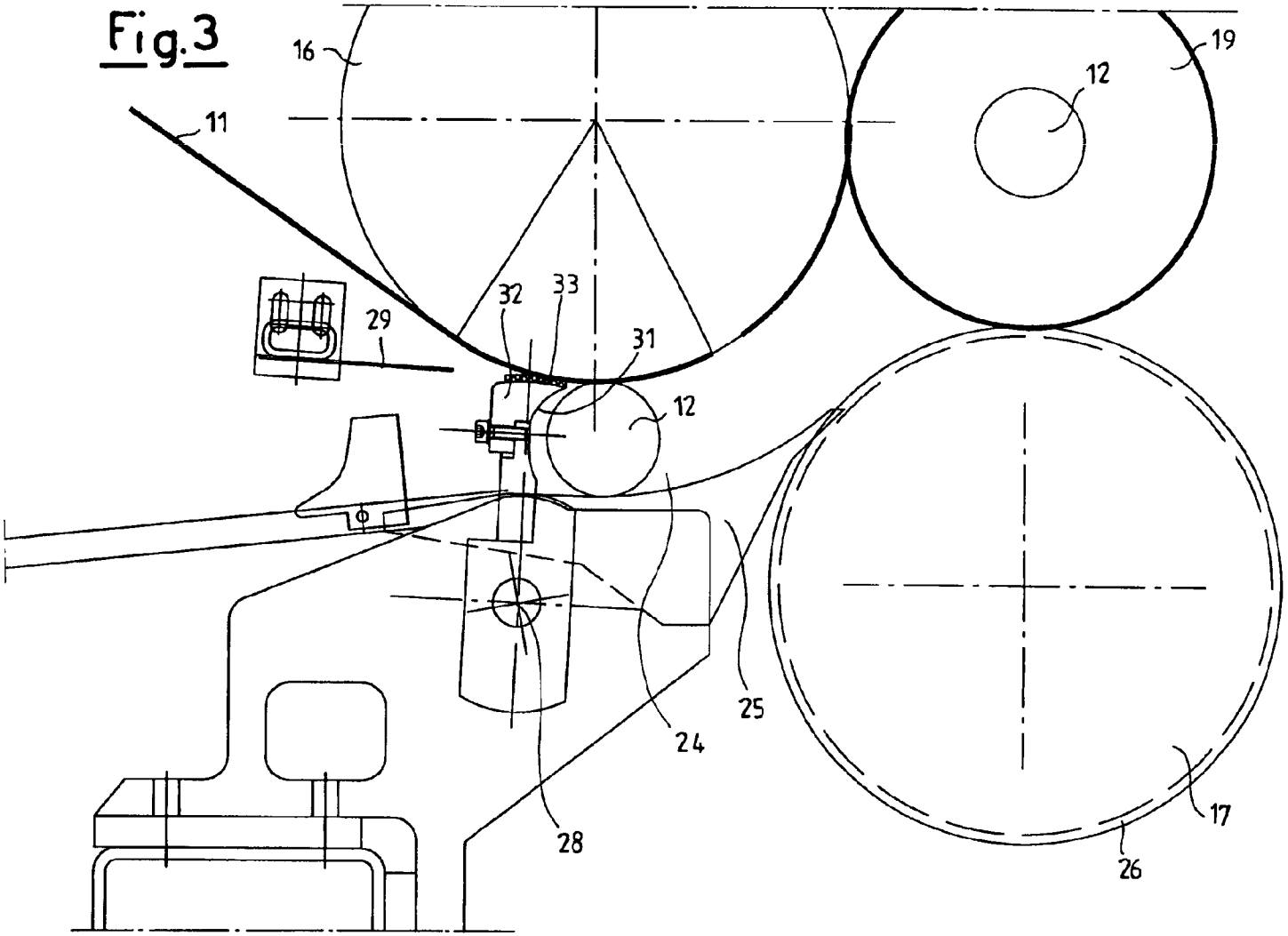
FIG. 3 illustrates a third step of release of the core and tearing of the paper for the formation of a new roll.

As shown in FIGS. 1–3, moreover provided in a position corresponding to the channel 24, namely at the intake in the example of embodiment illustrated, is a pusher 27, oscillating or rotating about a pin 28, which inserts the core 12, possibly provided with adhesive, within the channel 24. In fact, the pusher 27 is provided with a housing 31 which receives a core 12 arriving on a pusher 15 of the conveyor 13. This operation is obtained by at least partial rotation of the pusher 27, which, as it proceeds, draws along the core in the proximity of the intake of the channel 24, for example after the core has received the adhesive in 29 (FIG. 2).

The aforesaid movement then proceeds until (FIG. 3) the pusher 27 releases the core 12 in the channel, which has a size very close to that of the core. In the example illustrated in FIG. 3, at the same time an end appendage 32 of the pusher 27, which is provided with friction material 33, interferes with the paper 11 which has come to rest at least partially on the top roller 16 and is being carried by the latter. There is thus obtained an element for at least partial arrest of the paper upstream of the channel 24, before the point of introduction of the core 12, the said element acting on any moving element that co-operates in feeding the paper 11. The said moving element may be the top winding roller 16, another roller, or some other moving element of any sort.

The above makes it possible to facilitate and co-operate in the operation of tearing of the paper in the channel 24 in close vicinity to the intake aperture 20, the said operation being basically performed by the acceleration of the pressure roller 18. In fact, the said acceleration causes tearing of trailing end of the finished log 19 and brings about winding of the leading end of the next web of paper 11 directly onto the new core 12. In fact, as soon as the acceleration of the pressure roller 18 has brought about tearing the trailing end of a finished log 19, a new core 12 is inserted into the channel 24 by the pusher 27.

FIGS. 1 to 3 show a first step in which the three rollers 16, 17 and 18 support an almost finished log, whilst upstream of the intake of the channel 24 there is set a new core 12 that is ready to be introduced. Introduction is possible thanks to the pusher 27, which picks up the core 12 from the conveyor and inserts it into the channel 24.

FIG. 3 shows how the acceleration of the pressure roller 18 brings about tearing of the trailing end of the finished log 19 and how the new core 12, which has entered the channel 24, supported by the curved elements 25, can receive the leading end of the paper 11 that is being fed continuously. This step also includes the co-operation of the appendage 32 of the pusher 27, which has the function of an arrest element for at least partial arrest of the paper and which blocks the paper on the top roller 16 which is rotating, or on a moving element. This takes place in an area upstream of the point of insertion of a core into the channel, without a complicated co-ordination between the parts, as instead occurs in known devices.

Figure 4:
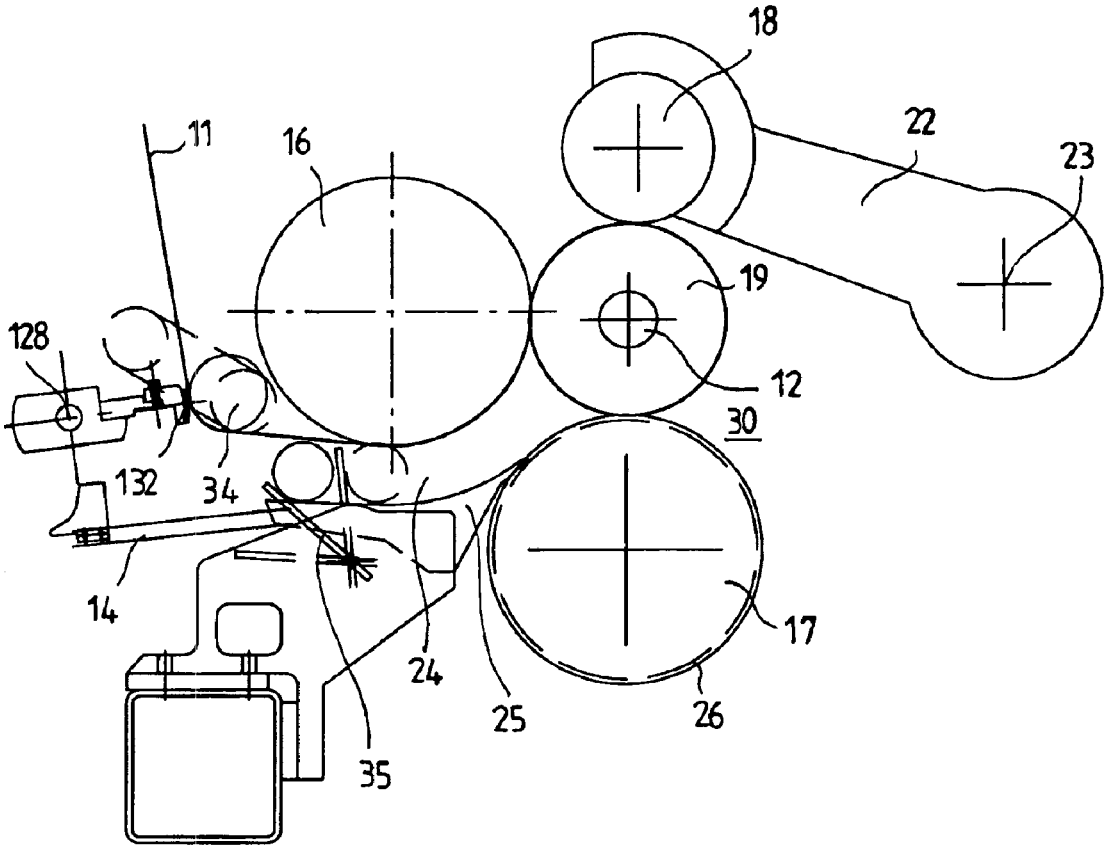
FIG. 4 shows a second example of embodiment of the present invention.

In FIG. 4, elements that are the same are designated by the same reference numbers. FIG. 4 shows that there is provided a pusher 35 the only function of which is to insert the cores 12, after discharging them one after another from the conveyor 13, into the channel 24 in a position corresponding to that of discharge of the finished log and start of a new roll that is to be formed.

Upstream of the aforesaid pusher and alongside the top roller 16, i.e., upstream of the point of insertion of the core, there is provided a further roller 34 for deviating the paper 11 that is being fed to the device.

It is precisely on the paper 11 that is wound and advances on said deviator roller 34, that a separate arrest element for at least partial arrest of the paper acts, upstream of the point of introduction of the cores and upstream of the channel 24. The arrest element, in this case, consists of an arm 132 that rotates about a position-adjustable pin 128. Also the outermost end of the arm 132 can be provided with friction material 133 for interfering with the paper 11 and achieving more reliable engagement.

There is thus created a further arrest element that acts on a moving element (in this case, the roller 34, but possibly an element of a different type, such as a translating surface).

The provision of the deviator roller 34, which is set alongside the top roller 16 or above it, moreover keeps the paper stretched, preventing return backwards of the paper 11, which is torn by the pressure roller 18, the said stretching being obtained by means of constant winding of the paper.

FIG. 5 shows a third embodiment, which is very similar to that of FIG. 4 where the deviator roll 34 is eliminated. The arm 132, which rotates around the pin 128, acts directly on the paper 11 contacting the top roller 16. This contact is before or simultaneously the pusher 35 introduces the core 12. In this way, there is a co-ordination between the tear of paper and winding of the leading of the paper over the new core 12.

The above arrangement makes it possible to eliminate the means of interruption of the ribbon-like material envisaged in the prior art along the channel, namely between a point of insertion of a new core and an outlet point for the core so that the latter sets itself between the three rollers for winding of the roll, thus eliminating problems of co-ordination and considerably simplifying the device.

The particular structure of the device of the present invention, when incorporated into a machine designed for making rolls of paper, as has been said previously, thus makes it possible to have maximum functionality with minimum presence of working parts.

A device according to the invention makes it possible to accelerate considerably the operation of the entire machine, with a consequent increase in the number of logs produced.

It is evident that the example of embodiment illustrated is only one of the possible embodiments. It may be understood that further examples of embodiments may be devised, all falling within the same innovative idea of the present invention.

What is claimed is:

1. A device for re-reeling and forming a roll of paper in a re-reeling machine comprising three rollers (16, 17, 18) having mutually parallel axes that are perpendicular to the direction of feed of paper (11), wherein said three rollers are supported on a frame, wherein two of said rollers are winding rollers, a bottom winding roller (17) and a top winding roller (16), which co-operate with a third roller (18) that maintains a certain pressure on said roll of paper or log, wherein said third roller (18) is supported by a pair of arms (22) which oscillate with respect to said frame, wherein said paper (11) passes over said top winding roller (16), and a finished roll or log (19) comes out of an outlet aperture or gap (30) located between said bottom winding roller and said third roller, wherein cores (12) for said rolls of paper which are fed one after another by a pusher (15) of conveyor (13) are introduced at a point of insertion into a channel (24) located underneath said top winding roller (16) by an oscillating pusher (27, 35) which co-operates to insert said cores (12) between said two winding rollers, said re-reeling machine further comprising an arrest element (32, 132) located at a point outside said channel (24) for at least partial arrest of said paper (11) upstream of said point of insertion of said cores (12) and wherein said arrest element for at least partial arrest of said paper is set at one end of said oscillating pusher (27, 35) for tearing said paper (11) upstream of channel (24).

2. The device according to claim 1, wherein said arrest element positioned upstream of said point of insertion of said cores (12) for at least partial arrest of said paper is provided, at one free end, with friction material.

3. The device according to claim 1, wherein said channel (24) is identified by curved elements (25) set underneath said top winding roller (16).

4. The device according to claim 1, wherein said curved elements (25) are set side by side and are designed to be inserted at least partially, by means of their ends, with grooves (26) made in said bottom winding roller (17).

5. The device according to claim 1, wherein said oscillating pusher is provided with adhesive.

6. A device for re-reeling and forming a roll of paper in a re-reeling machine comprising three rollers (16, 17, 18) having mutually parallel axes that are perpendicular to the direction of feed of paper (11), wherein said three rollers are supported on a frame, wherein two of said rollers are winding rollers, a bottom winding roller (17) and a top winding roller (16), which co-operate with a third roller (18) that maintains a certain pressure on said roll of paper or log, wherein said third roller (18) is supported by a pair of arms (22) which oscillate with respect to said frame, wherein said paper (11) passes over said top winding roller (16), and a finished roll or log (19) comes out of an outlet aperture or gap (30) located between said bottom winding roller and said third roller, wherein cores (12) for said rolls of paper which are fed one after another by a pusher (15) of conveyor (13) are introduced at a point of insertion into a channel (24) located underneath said top winding roller (16) by an oscillating pusher (27, 35) which co-operates to insert said cores (12) between said two winding rollers said re-reeling machine further comprising an arrest element (132) located at a point outside said channel (24) for at least partial arrest of said paper (11) upstream of said point of insertion of said cores (12) and wherein said arrest element (132) is adjacent said top winding roller (16) on which said arrest element acts, said arrest element (132) being positioned for rotation around a pin (128) of said arrest element (132), where said arrest element is positioned upstream of said channel (24).

7. The device according to claim 6, wherein said oscillating pusher is provided with adhesive.

* * * * *